United States Patent [19]

Hart

[11] Patent Number: 4,801,774

[45] Date of Patent: Jan. 31, 1989

[54] CENTER-SUPPORTED MICROWAVE TRAY

[75] Inventor: Joseph J. Hart, Philadelphia, Pa.

[73] Assignee: Container Corporation of America, Clayton, Mo.

[21] Appl. No.: 125,695

[22] Filed: Nov. 24, 1987

[51] Int. Cl.[4] ..... H05B 6/64

[52] U.S. Cl. ..... 219/10.55 E; 99/449; 99/DIG. 14; 229/104; 229/120.16; 229/903

[58] Field of Search ..... 229/104, 16 R, 16 D, 229/120, 120.16, 903; 219/10.55 E, 10.55 F; 99/422, 426, 448, 449, 451, DIG. 14, 646 C; 248/174, 459, 460, 469, 472; 426/107, 113, 234, 237, 241, 243, 244, 126; 206/45.21, 45.22, 45.25, 45.26, 45.29, 45.14, 45.19

[56] References Cited

U.S. PATENT DOCUMENTS

| | | | |
|---|---|---|---|
| 569,410 | 10/1896 | Dahlberg | 248/459 |
| 962,932 | 6/1910 | Trum | 248/459 |
| 1,682,963 | 9/1928 | Hardy | 206/45.26 |
| 1,901,351 | 3/1933 | Marx | 206/45.14 |
| 2,380,076 | 7/1945 | Schweyer | 248/459 |
| 2,483,533 | 10/1949 | Dubiner | 206/45.19 |
| 2,788,596 | 4/1957 | Schwartz | 248/459 |
| 2,797,855 | 7/1957 | Moore | 229/120.16 |
| 2,803,076 | 8/1957 | Viglietta | 248/459 |
| 3,001,684 | 9/1961 | Wenzel | 229/16 D |
| 3,131,850 | 5/1964 | Redpath | 229/120.16 |
| 3,219,181 | 11/1965 | Dahm | 206/45.21 |
| 3,285,493 | 11/1966 | Coe et al. | 229/120.26 |
| 4,230,924 | 10/1980 | Brastad et al. | 219/10.55 E |
| 4,260,060 | 4/1981 | Faller | 99/DIG. 14 |
| 4,320,839 | 3/1982 | Skaggs | 229/104 |
| 4,345,133 | 8/1982 | Cherney et al. | 219/10.55 E |
| 4,509,712 | 4/1985 | Moller | 248/472 |
| 4,567,341 | 1/1986 | Brown | 219/10.55 E |
| 4,610,363 | 9/1986 | Flum et al. | 248/174 |
| 4,612,431 | 9/1986 | Brown et al. | 219/10.55 F |
| 4,656,325 | 4/1987 | Keefer | 219/10.55 F |
| 4,661,671 | 4/1987 | Maroszek | 219/10.55 E |
| 4,705,929 | 11/1987 | Atkinson | 219/10.55 E |

FOREIGN PATENT DOCUMENTS

| | | | |
|---|---|---|---|
| 2109473 | 9/1972 | Fed. Rep. of Germany | 248/459 |

*Primary Examiner*—Harvey C. Hornsby
*Assistant Examiner*—Joseph S. Machuga
*Attorney, Agent, or Firm*—Richard W. Carpenter

[57] ABSTRACT

A disposable, self-supported tray, for holding food in a microwave oven, which tray includes a paperboard center panel coated on at least one side with a conductive material and supported at the periphery and in the center by downwardly extending panels, certain of which have interlocking engagement with each other.

6 Claims, 2 Drawing Sheets

CENTER-SUPPORTED MICROWAVE TRAY

BACKGROUND OF THE INVENTION

1. Field of the Invention:

This invention relates to trays, and more particularly to a disposable, self-supported tray for holding food in a microwave oven.

2. Description of Background Art

A background search directed to the subject matter of this application in the U.S. Patent and Trademark Office disclosed the following U.S. Pat. Nos.: 4,638,941, 4,612,431, 4,592,914, 4,574,174, 4,355,757, 4,283,427, 4,279,374, 4,260,060 4,228,945, 4,136,817, 4,096,948.

None of the patents uncovered in the search discloses a disposable tray for supporting food while it is being heated and browned in a microwave oven, which tray includes a dielectric center panel, coated with conductive material, and supported at the periphery and in the center by downwardly extending panels, certain of which have interlocking engagement with each other.

SUMMARY OF THE INVENTION

It is a primary objective to provide a disposable paperboard tray for use in heating food in a microwave oven.

Another object of the invention is to provide a tray of the type described which has integral support means for maintaining the upper surface of the tray in a level position at all times while it is being used to hold food in a microwave oven.

A more specific object of the invention is the provision of a paperboard tray having a center panel supported at its periphery and at its center by downwardly extending panels, certain of which have interlocking engagement with each other.

These and other objects of the invention will be apparent from an examination of the following description and drawings.

BRIEF DESCRIPTION OF THE DRAWINGS

FIG. 4 is a perspective view of a tray embodying features of the present invention;

FIG. 5 is a transverse, vertical, sectional view taken on line 5—5 of FIG. 4; and FIG. 6 is a fragmentary, bottom plan view of a portion of the structure illustrated in FIG. 1, with the center supporting structure enlarged and shown in the erected position.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
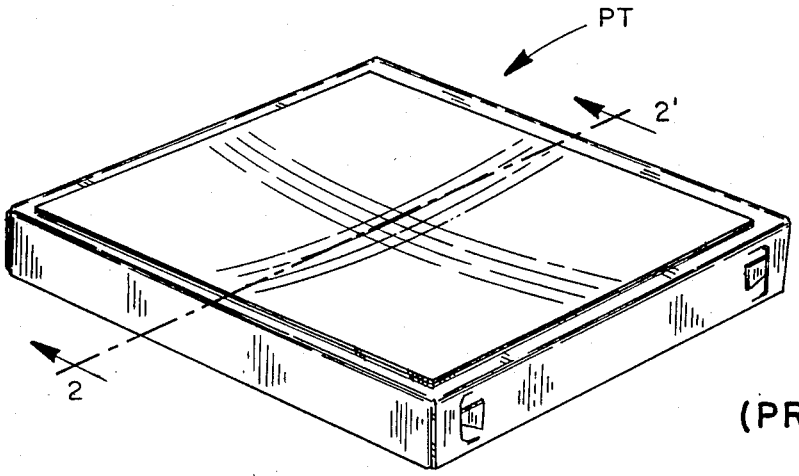
FIG. 1 (PRIOR ART)
FIG. 1 is a fragmentary perspective view of a conventional tray of the type used for supporting food while it is being heated in a microwave oven.
Figure 2:
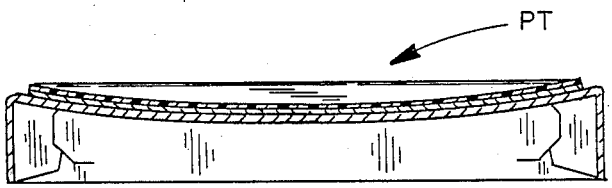
FIG. 2 (PRIOR ART)
FIG. 2 is a transverse, vertical, sectional view taken on line 2—2 of FIG. 1.

In many cases a portion of a package is designed to be used as a tray for supporting an article of food, such as a pizza, in a microwave oven, so the food can be heated uniformly and preferably browned to some extent. The conventional prior art tray PT, illustrated in FIGS. 1 and 2, has a tendency to sag in the middle because of the lack of support. This causes the supporting surface of the food article to bow or bend downwardly and is undesirable from the standpoint of uniformity in browning the surface of the article positioned thereon.

The present invention represents an improvement in a tray of this type which has integral supporting structure to maintain the primary surface of the main panel of the tray in a level or horizontal position at all times.

Figure 3:
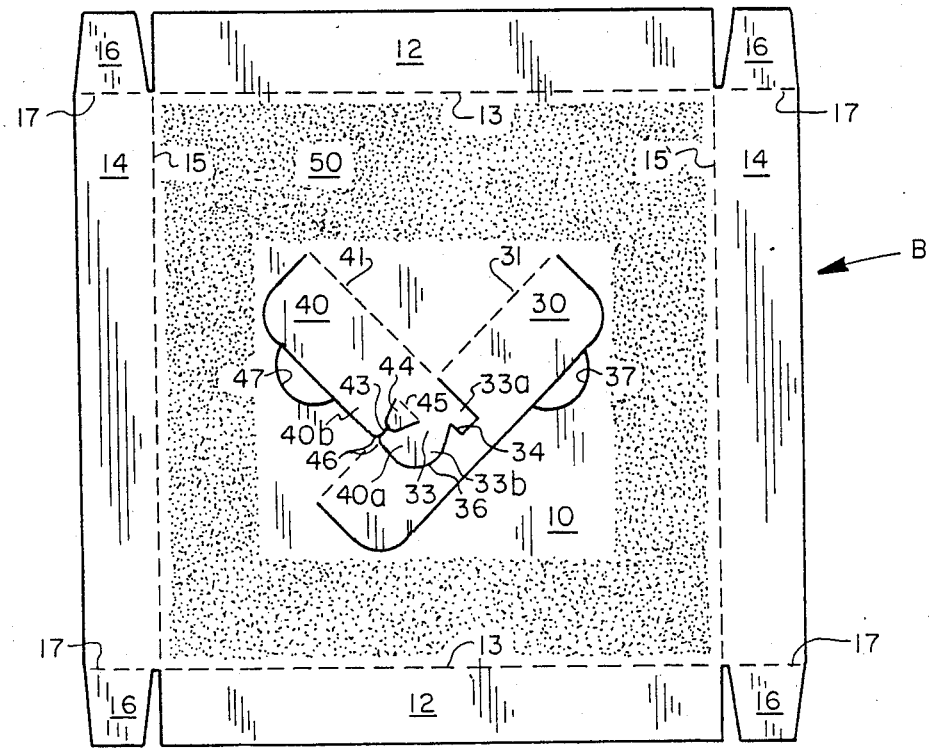
FIG. 3 is a top plan view of a blank foldable sheet material from which the tray embodying features of the present invention and illustrated in the remaining views may be formed.
Figure 1:
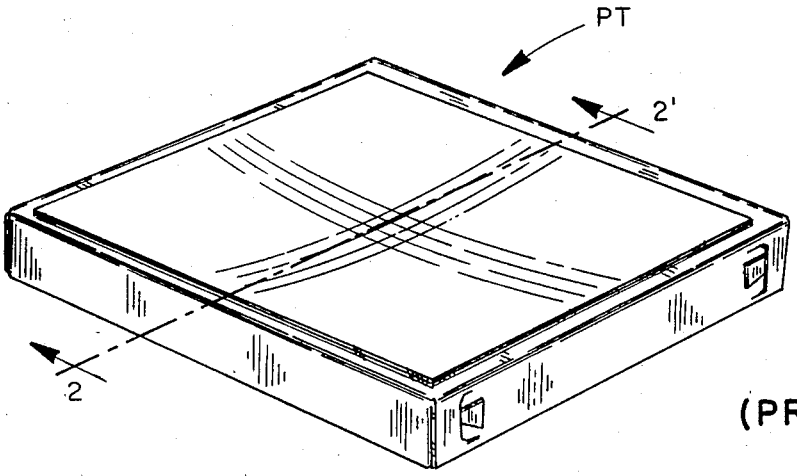
FIG. 1 (PRIOR ART)
Figure 2:
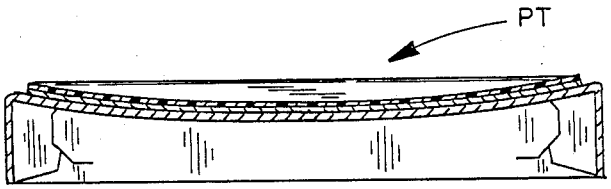
FIG. 2 (PRIOR ART)
Figure 3:
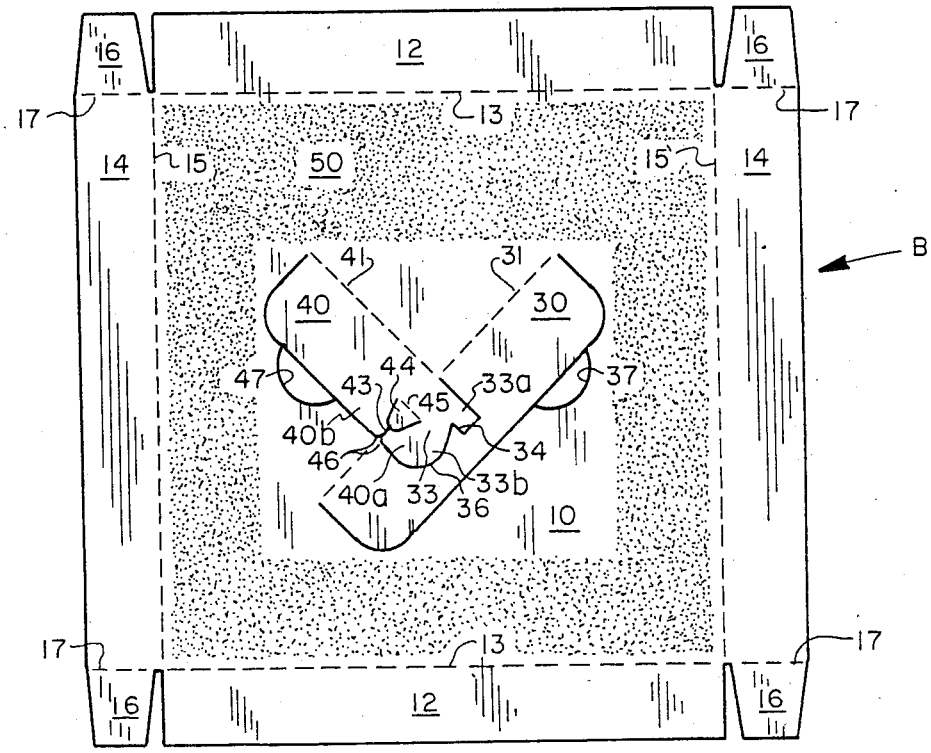

As best seen in FIGS. 3 and 4, the tray T embodying features of the present invention may be formed from the unitary blank B of, preferably dielectric, foldable sheet material, such as paperboard, illustrated in FIG. 3.

The tray includes a preferably rectangular center panel 10, having a pair of first side panels 12 foldably joined to opposed side edges thereof along fold lines 13, and a pair of second side panels 14 foldably joined to opposite side edges thereof along fold lines 15. Corner flaps 16 may be foldably joined along fold lines 17 to the ends of second side panels 14.

In forming the tray, all of the side panels are folded downwardly, with the corner flaps 16 of second side panels 14 being adhesively secured to adjacent surfaces of first side panels 12.

In order to assist in the browning of an article of food heated on the tray in a microwave oven, one surface, preferable the outer surface, of the center panel 10 may be coated with a discontinuous layer 20 of conductive material which is secured thereto by an adhesive pattern indicted generally at 50.

The discontinuous layer of conductive material includes an inner sub-layer 22 of metal covered by an outer sub-layer 24 of plastic film. The composite strips of metal and film are separated from each other by a plurality of spaces 25. This arrangement is not described in detail in this application, because it is the subject of a copending application Ser. No. 121,031, filed Nov. 16, 1987 in the name of inventors Joseph J. Hart, David J. C. Glasgow, and Richard W. Carpenter.

Still referring to FIGS. 3 and 4, it will be seen that the center of panel 10 is supported by a structure that includes a pair of first and second support panels 30 and 40, which are formed from material cut from center panel 10 and foldably joined therto along intersecting fold lines 31 and 41, respectively, that preferably extend in directions normal to each other.

First support panel 30 includes an opening 33 having first and second portions or areas **33*a* and 33*b*, respectively. Support panel 30 also includes an abutment or projection 34 extending into opening 33** between the separate areas of the opening.

Area **33*b* may be provided with a curved edge 36 to facilitate folding the second support panel 40 into interlocking engagement with the first support panel 30** as hereinafter described.

Second support panel 40 includes first and second sections **40*a* and 40*b*, respectively, which are separated from each other by an opening 43. Opening 43 is relatively small and narrows to a only a slit at the edge of the panel, so the abutting ends 46 of the respective panel sections 40*a* and 40*b* will engage opposite sides of panel 30** when the panels are erected to supporting position.

Panel 40 also includes a small tab 44, foldably joined thereto along fold line 45, which serves to lock the panels in position, as hereinafter described.

Center panel 10 may be provided with a pair of recesses 37 and 47, located adjacent panels 30 and 40, respectively, to facilitate grasping the panels, so they can be easily pulled away from center panel 10 and moved into interlocking position.

It should be noted that the glue pattern on the upper surface of center panel 10, indicated generally at 50 in FIG. 3, is designed to prevent the support panels 30 and 40 from becoming adhered to the layer 20 of conductive material that is attached to the upper surface of the inner panel 10.

Thus, in operation, when it is desired to use the tray to support an article of food in a microwave oven, the panels 30 and 40 may be grasped and pulled downwardly from the center panel, with the second panel 40 being received within the opening of the first panel 30, and with the small lock tab 44 engaging the stop or abutment 34 of the first panel to keep the panels interlocked to maintain them in erected position for supporting the center panel of the tray.

What is claimed is:

1. A disposable, one-piece, self-supported tray for holding food in a microwave oven, said tray being formed from a unitary blank of dielectric, foldable sheet material, such as paperboard, and comprising:

(a) a center panel having a periphery, a center portion, a plurality of side edges, at least one surface, and a relatively thin layer of conductive material on said one surface;

(b) a plurality of side panels foldably joined to each other and to said side edges and extending downwardly therefrom for supporting said center panel at said periphery;

(c) an integral supporting structure, for supporting said center panel center portion, including:

(i) first and second support panels formed soley from material cut from said center panel and foldably joined thereto along intersecting fold lines extending normal to each other;

(ii) said support panels being disposed to extend downwardly from and normal to said center panel;

(iii) said first support panel having an opening therein and an abutment projecting into said opening;

(iv) said second support panel including a pair of co-planer sections separated by a relatively narrow opening for receiving and engaging the abutment of said first support panel, when one of said second support panel sections is received within said first support panel opening, to maintain said support members in interlocking relationship.

2. A disposable, one-piece, self-supported tray for holding food in a microwave oven, said tray being formed from a unitary blank of dielectric, foldable sheet material, such as paperboard, and comprising:

(a) a center panel having a periphery, a center portion, a plurality of side edges, at least one surface, and a relatively thin layer of conductive material on said one surface;

(b) a plurality of side panels foldably joined to each other and to said side edges and extending downwardly therefrom for supporting said center panel at said periphery;

(c) an integral supporting structure, for supporting said center panel center portion, including:

(i) first and second support panels formed soley from material cut from said center panel and foldably joined thereto along intersecting fold lines extending normal to each other;

(ii) said support panels being disposed to extend downwardly from and normal to said center panel and having interlocking engagement with each other;

(iii) one of said support panels having a portion received within an opening in the other support panel to provide said interlocking engagement between said support panels.

3. A disposable, one-piece, self-supported tray for holding food in a microwave oven, said tray being formed from a unitary blank of dielectric, foldable sheet material, such as paperboard, and comprising:

(a) a center panel having a periphery, a center portion, a plurality of side edges, at least one surface, and a relatively thin layer of conductive material on said one surface;

(b) a plurality of side panels foldably joined to each other and to said side edges and extending downwardly therefrom for supporting said center panel at said periphery;

(c) an integral supporting structure, for supporting said center panel center portion, including:

(i) first and second support panels formed soley from material cut from said center panel and foldably joined thereto along intersecting fold lines;

(ii) said support panels being disposed to extend downwardly from and normal to said center panel and having interlocking engagement with each other to maintain them in supporting position.

4. A tray according to claim 3, wherein when said support panels are folded downwardly into supporting position, and wherein a portion of said second panel is received within an opening in said first support panel.

5. A tray according to claim 4, wherein said second support panel has a lock tab engageable with an abutment projecting into said first panel opening to maintain said panels in interlocking engagement.

6. A tray according to claim 4, wherein said second support panel includes a pair of sections partially separated from each other by a slit, and wherein a portion of said first support panel is received within said slit, so that second support panel sections are disposed on opposite sides of said first support panel.

* * * * *